US005762946A

United States Patent [19]

Gueret

[11] Patent Number: 5,762,946

[45] Date of Patent: Jun. 9, 1998

[54] FOAM PAD FOR THE CARE AND TOPICAL TREATMENT OF THE SKIN

[75] Inventor: Jean-Louis H. Gueret, Paris, France

[73] Assignee: L 'Oreal, Paris, France

[21] Appl. No.: 717,188

[22] Filed: Sep. 20, 1996

[30] Foreign Application Priority Data

Sep. 21, 1995 [FR] France ..... 95-11111

[51] Int. Cl.[6] ..... A61K 7/43

[52] U.S. Cl. ..... 424/401; 424/434; 424/486; 424/402

[58] Field of Search ..... 424/434, 78, 486, 424/401, 402

[56] References Cited

U.S. PATENT DOCUMENTS 2,204,202 6/1940 Zimmerman .
3,337,895 8/1967 Clements .
4,776,356 10/1988 Jou et al. .

FOREIGN PATENT DOCUMENTS 772967 11/1934 France .
474732 11/1937 United Kingdom .

*Primary Examiner*—Thurman K. Page
*Assistant Examiner*—D. Faulkner
*Attorney, Agent, or Firm*—Oblon, Spivak, McClelland, Maier & Neustadt, P.C.

[57] ABSTRACT

The invention relates to foam pads for the care and topical treatment of, including for making up, the skin, nails, hair and mucosa. These pads can comprise and diffuse a care and topical treatment product which is encapsulated between two sheets of foam. They are provided with at least one weld which gives them softness and flexibility.

22 Claims, 1 Drawing Sheet

FOAM PAD FOR THE CARE AND TOPICAL TREATMENT OF THE SKIN

BACKGROUND OF THE INVENTION

1. Field of the Invention

The invention relates to novel foam pads for the care and topical treatment of the skin, nails, hair and mucosa. These pads include a hinge seam forming a rim.

2. Discussion of the Background

Pads are normally used for spreading a pasty or powdery product on the skin or mucosa, while at the same time effecting a gentle massage of the surface to be treated. Impregnated with water, or with an aqueous or aqueous/alcoholic solution, or employed on their own, they also serve to remove a product which has been spread on the skin, for example a cleansing milk. They are applied to the skin with a greater or lesser degree of pressure, depending on the use being made of them. Consequently, these pads are expected to give a firm hold in the hand and to have a pleasant feel.

Pads for the care of, and/or for making up, the skin are known, see for example GB-A-0474732 and U.S. Pat. No. 2,204,202. GB-A-0474732 describes pads comprising two walls between which a powder is encapsulated. The two walls are joined to one another by radial seams starting from the periphery of the pad. One of the walls is covered by an impervious member, adapted to retain a quantity of powder adjacent to the thin wall. This impervious member prevents a complete mixture and foaming of the powdery product with water, when the pad in dipped into water.

U.S. Pat. No. 2,204,202 describes a pad comprising a circular sheet of foam. A notch has been cut in the thickness of this sheet to form a pocket in which a product can be inserted. This pad is made of a latex body with a high density and a latex skin having small pores. Such a material prevents a complete mixture and foaming of the powdery product with water when the pad is dipped into water. Neither of these documents mentions or suggests a pad having a hinge seam which forms a rim.

Other pads known in the art are made of cotton or of foam. Pads made of cotton, like pads made of very thin foam, lack strength and grip and this makes them less easy to use. Although pads made of thick foam do not have these disadvantages, they have a rough feel in the area of the seam. Being rigid, they do not permit a surface with irregular contours to be reached in a uniform manner.

In addition, in all sectors, and particularly for the care and topical treatment of the skin, the busy consumer is looking for ready-to-use products which are easy to manage, are disposable and are at least as efficient as traditional products.

SUMMARY OF THE INVENTION

Thus, one object of the present invention is to provide novel foam pads which have a pleasant feel and provide a firm hold in the hand, and with which it is possible to follow all the contours of the surface to be treated, and which are able to distribute a care or topical treatment product.

This and other objects which will be apparent hereinafter are solved by the present invention. The invention relates to foam pads for the care and topical treatment of, in particular for making up, cleansing, gently treating and caring for, the skin, nails, hair and mucosa, these pads comprising at least one sheet of foam equipped with a hinge weld forming a rim. They are more manageable and softer than pads of the prior art. The pads of the present invention have wide pores to allow a complete mixture and foaming of the powdery product with water.

DETAILED DESCRIPTION OF THE PREFERRED EMBODIMENTS

Figure 1:
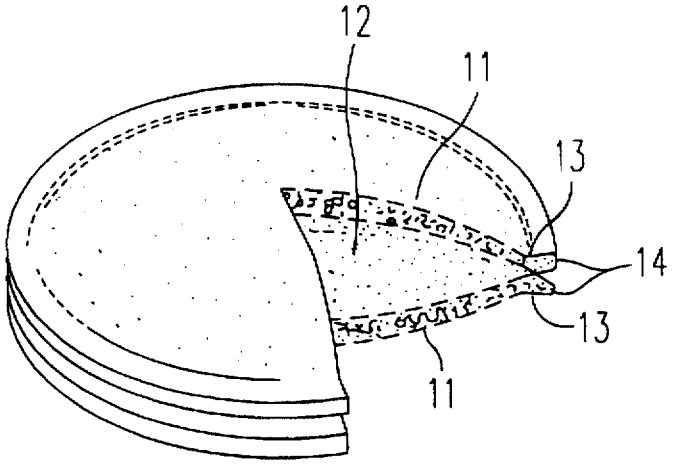
FIG. 1 represents a pad according to the invention, equipped with a hinge weld, in a perspective view, and with a part cut out.

The pads of the present invention comprise at least a single sheet of foam.

These pads can be impregnated with a product for the care and topical treatment of the skin, including a make-up product.

These pads can also comprise two sheets of foam of substantially identical size and contours, which are superposed edge to edge and between which there is encapsulated a powder of a water-soluble or water-emulsifiable product (such as a cosmetic, dermatological or pharmaceutical product), the two sheets being held together by at least one weld along their periphery.

As used herein, powder means a loose powder, dispersed in a binder or compacted. The powder can include unit grain sizes ranging from 50 nm to 3.5 mm, preferably from 100 nm to 300 μm, and still more preferably from 5 μm to 150 μm.

Suitable welds give the pad a flattened spheroidal shape, as well as a better hold in the hand, which a sheet of foam of the same thickness does not possess.

According to the invention, as long as the pad is dry, the product remains encapsulated between the two sheets of foam. When it is wetted, the product dissolves or emulsifies and then diffuses towards the surface of the pad so as to be applied to the surface which is to be treated.

Suitable foams employed to make the pads according to the present invention can be of any type, including polyester, polyether, polyethylene, polystyrene, polyurethane, polyvinyl chloride foams, etc. These foams are foams with open cells or half-open cells, whose size depends on the grain size of the powder. In practice, these cells have a width ranging from 1 μm to 3.5 mm.

The two sheets of foam can be of different types, density, thickness or surface characteristics. For example, the sheets can be covered with woven fabric, flock or elastomer. They can be of different colors, relief and thickness.

The weld can be formed by any means known to the skilled person, for example by adhesive bonding, ultrasound, high-frequency waves, or mechanical compression.

The weld can be set back from the periphery (hinge weld). On either side of the weld, the foam sheets diverge away from each other and form a bulge. Thus, the outer edge of the foam sheets forms a rim which is more or less rounded depending on the width of this rim. Between the central part of the pad and the rim, the weld acts as a hinge: when the pad is moved across the surface to be treated, the rim yields like the end of a brush, and this allows it to reach zones of accentuated relief, for example the surface of the face, and more especially the wings of the nose and the contours of the eyes.

In addition to the advantages described hereinabove, when impregnated with water, the pad with hinge weld diffuses the product in a more regular and uniform manner than other types of pads. When a pad according to the prior art, once wetted, is subjected to the pressure of the fingers, it allows drops of liquid to escape, whereas the pad with hinge weld according to the invention does not form drops and deposits an even liquid film over the surface to be treated. In addition, the flexible and rounded rim of the pad of the present invention is more flexible and softer than the rims of the pads of the prior art.

The thickness of the pad of the present invention, that is to say the sum of the thicknesses of the two sheets of foam without product interdisposed, is from 3 to 30 mm, preferably from 4 to 20 mm, and still more preferably from 6 to 12 mm.

The weld can be of variable width and must be adapted by the skilled person to the intended use. The rim can have a width ranging from 0.1 to 20 mm, preferably from 1 to 15 mm, and still more preferably from 1.5 to 10 mm. The rim width is defined as the distance between the edge of the sheet(s) of foam and the weld.

The products employed in the pads according to the invention can be cosmetic, dermatological or pharmaceutical products for topical application. They are introduced into the pads according to the invention in the form of a powder, solid gel or cake. Examples which way be mentioned are soaps, shampoos, make-up removers, make-up products, sun products, care creams, plant or animal extracts, vitamins, proteins, enzymes, mineral salts, trace elements, etc.

Theme products are made into the desired physical form by all the means which are known to the skilled person: lyophilization, atomization, dehydration, crystallization, etc. The external shape of the pads thus produced is usually round, but they can also have another geometric or fancy shape. The weld encloses a portion of the surface of the pad.

The weld can be concentric to the shape of the pad, but it can also be eccentric or transverse with respect to the shape of the pad. The pad can have several hinge welds, preferably concentric ones.

According to a variant of the invention, the weld can be partially a peripheral weld (situated on the periphery of the pad) and partially a hinge weld, in which case only part of the perimeter of the pad has a rim.

The pad according to the invention being equipped with a hinge weld, the rim can additionally be closed by a peripheral weld, the two welds being substantially concentric.

The weld can have different profiles and reliefs as a function of the tool which is used to form the weld. For example, it can be flat, convex or concave, or can have a fancy profile.

A method for producing pads according to the invention consists of arranging the product at the center of a sheet of foam, then superposing the sheets in such a way that the product is arranged between the two sheets, and finally welding the sheets to each other in such a way as to encapsulate the product. The sheets are welded by any means known to the skilled person. The peripheral welds are obtained by cutting the foam level with the weld.

Alternatively, pads can first be produced as described above without product. Thereafter, the pads can be impregnated with a solution or an emulsion of the desired product, and then dehydrated.

The pad represented in FIG. 1 comprises two sheets 11 of foam, a topical treatment and care product 12 placed between the two sheets, a hinge weld 13 which pinches the sheets of foam together, and a rim 14. The foam is such as defined above.

Figure 2:
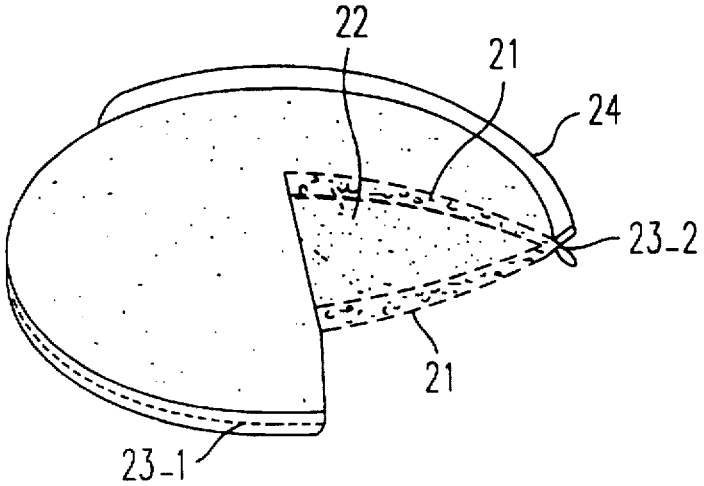
FIG. 2 represents a pad according to the invention, equipped with a weld which is partially a peripheral weld and partially a hinge weld, in a perspective view, and with a part cut out.

The pad represented in FIG. 2 comprises two sheets 21 of foam, a topical treatment and care product 22 placed between the two sheets and a weld which pinches the sheets of foam together. This weld is a peripheral weld 23.1 over a first part of the perimeter of the pad and a hinge weld 23.2 over the other part of this perimeter. The hinge weld 23.2 forms a rim 24.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters: Patent of the United Stated is:

1. A foam pad having open or half open cells for the care and topical treatment of the skin, nails, hair and mucosa, comprising at least one sheet of foam equipped with a hinge weld forming a rim, the hinge weld being set back from the periphery of the pad, allowing the portion of the pad constituting the rim to yield about the hinge weld acting as a hinge.

2. The pad of claim 1, which comprises two sheets of foam of substantially identical size and contours, which are superposed edge to edge and between which there is encapsulated a powder of a water-soluble or water-emulsifiable product, the two sheets being held together by the weld.

3. The pad of claim 2, wherein said product is a cosmetic, dermatological or pharmaceutical product.

4. The pad of claim 1, wherein said pad is from 3 to 30 mm thick.

5. The pad of claim 1, wherein said pad is from 4 to 20 mm thick.

6. The pad of claim 5, wherein said pad is from 6 to 12 mm thick.

7. The pad of claim 1, wherein said weld forms a rim with a width ranging from 0.1 to 20 mm.

8. The pad of claim 7, wherein said weld forms a rim with a width ranging from 1 to 15 mm.

9. The pad of claim 8, wherein said weld forms a rim with a width ranging from 1.5 to 10 mm.

10. The pad of claim 1, which comprises a plurality of concentric welds.

11. The pad of claim 1, wherein said foam has cells with a width ranging from 1 μm to 3.5 mm.

12. The pad of claim 1, which comprises a weld which is partially a peripheral weld and partially a hinge weld.

13. The pad of claim 3, wherein said product is selected from the group consisting of soaps, shampoos, make-up removers, make-up products, sun products, care creams, plant or animal extracts, vitamins, proteins, enzymes, mineral salts and trace elements.

14. The pad of claim 2, wherein said product has a unit grain size ranging from 50 nm to 3.5 mm.

15. The pad of claim 12, wherein said unit grain size is from 100 nm to 300 μm.

16. The pad of claim 16, wherein said unit grain size is from 5 μm to 150 μm.

17. The pad of claim 1, which comprises a single sheet of foam.

18. The pad of claim 1, which is impregnated with a product for the treatment and topical care of the skin.

19. A method for producing foam pads having open or half open cells for the care and topical treatment off, the skin, nails, hair and mucosa, comprising at least one sheet of foam having open or half-open cells equipped with a hinge weld forming a rim, the method comprising (i) superposing said sheet(s) in such a way that a pocket is formed, and (ii) thereafter welding said sheet(s) to form a hinge weld, the hinge weld being set back from the periphery of the pad, allowing the portion of the pad constituting the rim to yield about the hinge weld acting as a hinge.

20. The method of claim 19, further comprising (iv) impregnating said foam pad with a solution or an emulsion of a care and topical treatment product, and then dehydrating said foam pad.

21. The method of claim 19, comprising (i) arranging a product at the center of a sheet of foam, (ii) then superposing said sheets in such a way that said product is arranged between the two sheets, and (iii) finally welding said sheets to each other in such a way as to encapsulate said product.

22. A foam pad having open of half open cells for the care and topical treatment of the skin, nails, hair and mucosa, comprising at least one sheet of foam equipped with a weld enclosing a portion of the surface of the foam pad, the weld forming with the foam pad within the boundary defined by the weld, a structure for retaining a product for such care and topical treatment, the weld being at least in part a hinge weld forming a rim, the hinge weld being set back from the periphery of the pad, allowing the portion of the pad constituting the rim outside the part of the boundary defined by the hinge weld to yield about the hinge weld acting as a hinge.

* * * * *